US006425344B1

(12) United States Patent
Strahm et al.

(10) Patent No.: US 6,425,344 B1
(45) Date of Patent: Jul. 30, 2002

(54) DEVICE FOR COATING A WEB-LIKE SHEET FORMATION

(75) Inventors: Christian Strahm, Bronschhofen; Thomas Gerbig, Kreuzlingen, both of (CH)

(73) Assignee: Solipat AG, Zug (CH)

( * ) Notice: Subject to any disclaimer, the term of this patent is extended or adjusted under 35 U.S.C. 154(b) by 0 days.

(21) Appl. No.: 09/030,378

(22) Filed: Feb. 25, 1998

(30) Foreign Application Priority Data

Feb. 26, 1997 (CH) ..... 439/97

(51) Int. Cl.[7] ..... B05C 19/06

(52) U.S. Cl. ..... 118/620; 118/621; 118/63; 118/67; 118/68; 118/308

(58) Field of Search ..... 118/63, 67, 68, 118/308, 621, 620

(56) References Cited

U.S. PATENT DOCUMENTS 2,169,078 A * 8/1939 Waite ..... 118/63
4,857,367 A * 8/1989 Thorn et al. ..... 118/63
5,152,838 A * 10/1992 Kisler ..... 118/68
5,520,738 A * 5/1996 Aindow et al. ..... 118/621

FOREIGN PATENT DOCUMENTS

| | | |
|---|---|---|
| DE | 22 31 723 A | 1/1974 |
| DE | 44 05 549 A | 8/1994 |
| EP | 0 657 572 A | 6/1995 |
| EP | 0 745 430 A | 3/1996 |

* cited by examiner

*Primary Examiner*—Laura Edwards
(74) *Attorney, Agent, or Firm*—Shoemaker and Mattare

(57) ABSTRACT

With a method and a device for coating a continuously delivered, web-like sheet formation (2) a first layer (3) of a paste-like plastic is deposited in sections. A second layer (4) of powder-like thermoplastic plastic is subsequently flatly scattered on. The coated sheet formation (2) is subsequently subjected to thermal treatment. Before the thermal treatment, the powder (7) deposited between the sections of the first layer (3) is swirled up by an air jet (L) directed obliquely against the surface (6) of the sheet formation (2) and is simultaneously sucked off by a suction means (10).

1 Claim, 2 Drawing Sheets

DEVICE FOR COATING A WEB-LIKE SHEET FORMATION

The invention relates to a method and a device for coating a continuously delivered sheet formation, with the features of the preamble of the independent patent claims.

In coating technology it is known to manufacture interlinings with the so-called double-point method. The combination of two known coating methods (paste-point coating and scatter coating) permits the unification of the properties of various types of melting adhesive at one point which consists of the so-called lower point and of the upper point. A mostly thermoplastic material is deposited onto the sheet formation to be coated (typically a textile material web) at individual points (paste sections). Subsequently for forming the upper point a low melting plastic is scattered on. The low melting plastic forming the upper point sticks to the moist, sticky surface of the lower point. On the remaining surface of the sheet formation the plastic lies loosely. In a next method step the powder-like and low-melting adhesive which is scattered on is sucked off. Only on the lower points does the powder-like adhesive remain sticking and thus forms an exactly placed upper point.

In a subsequent method step the material web coated in this way undergoes a thermal treatment method and the powder layer which is scattered on is melted on and fixed.

With this double-point coating method there occurs various problems. As such it is particularly difficult to completely remove the powder-like layer which is scattered on in the regions outside the lower points. If there is still powder present between the individual lower points, then this is likewise fixed onto the sheet formation in the subsequent thermal treatment.

With known methods the sheet formations are hit/beaten in order to loosen the powder. Thereafter by way of suction means it is removed from the surface of the sheet formation. This method however is flawed with the disadvantage that due to the acceleration on beating, the powder penetrates the sheet formation. It may then only be sucked out of the sheet formation incompletely and with difficulty.

It is further also known to blow through the textile web with an air jet and to simultaneously suck of the particles on the opposite side. So that the textile web does not flutter or lift off during the blowing, it must however be held by suction means from below. By way of this, likewise a part of the powder is suctioned into the web and here sets firmly. Moreover this method is not applicable to all sheet formations since the effectiveness depends on the porosity of the material of the sheet formation. Dense material is difficult to blow through from below.

It is the object of the invention to avoid the disadvantages of that which is known, in particular to provide a method and a device for coating a sheet formation with a double-point layer which permits a reliable removal of the powder layer which is scattered on. The method and the device are also to be able to be simply carried out so that no additional measures for fixing the material web are necessary.

According to the invention these objects are achieved with a method and a device with the features of the characterising part of the independent patent claims.

With a method for coating a continuously supplied web-like sheet formation, in a first method step a paste-like plastic layer is deposited in sections distanced to one another, preferably in point-shaped sections. In a subsequent method step a second layer of a powder-like, thermoplastic plastic with a preferably lower melting temperature is scattered onto the first paste-like layer. This two-point coating subsequently undergoes a thermal treatment.

Before the thermal treatment, the powder deposited between the sections of the first plastic layer is swirled up by an air jet directed obliquely against the surface of the sheet formation. Simultaneously the powder particles which are swirled up are sucked off in a directed manner directly over the material web by way of a suction means. The air jet directed obliquely towards the surface of the sheet formation does away with the need for holding devices for the material web before the sucking off. The attack direction of the air jet and the turbulences in the region of the surface of the material web lead to an optimal release of the powder particles from the surface of the sheet formation.

In a particularly advantageous embodiment the air jet is directed at an angle of 80° to 30° to the surface of the sheet formation against this surface. The angle is preferably 75° to 60°.

In a further advantageous embodiment the air jet is directed towards the running direction of the sheet formation.

In a further preferred embodiment the material web in the region of the impinging air jet is led over an impact plate. This is particularly advantageous with sheet formations which are less dense. The impact plate on the one hand serves as a resting surface for the blow means and permits a quiet transport of the material. On the other hand in the start and deflection region of the air jet there forms turbulences, even with less dense material, which simplifies the releasing of the thermoplastic powder from the material web.

It has further been shown that it may be advantageous to submit the powder which is scattered on advantageously to an ionisation treatment. If the air jet is led through a heavy, electrical alternating field before impinging on the surface of the sheet formation, the static charge of the powder particles may be heavily reduced. With this, on the one hand the direct influence of the alternating field on the powder particles, and on the other hand the ionised air jet play their part. The arrangement of an alternating field reliably helps the removal of a static charge of the powder particles. The combination of the suctioning and blowing-on furthermore leads to an advantageous holding-down effect. The forces of the two air flows on the material web compensate one another.

The device according to the invention consists essentially of a coating arrangement for depositing the first paste-like layer and of a scattering arrangement for scattering on the second powder-like layer.

The device is moreover provided with a transport arrangement for conveying the sheet formation from the coating arrangement to the treatment arrangement connected thereafter.

Between the scattering arrangement for depositing the powder and the treatment arrangement connected thereafter there is provided a means for removing the powder deposited between the sections of the first layer. The means consist of a blow means for blowing an air jet directed obliquely to the surface of the sheet formation, and a suction means for sucking off the powder swirled up by the air jet.

Advantageously the blow means is arranged such that the blow jet impinges the surface of the sheet formation at an angle of 80° to 30°, preferably at 75° to 60°.

In a further preferred embodiment example the device according to the invention is further provided with an impact plate via which the sheet formation can be guided in the region of the blow means and of the suction means.

Furthermore the device is preferably provided with an ionisation arrangement for ionising the blow air and for producing an electrical alternating filed.

BRIEF DESCRIPTION OF THE DRAWINGS

Hereinafter the invention is described in more detail in an embodiment example and by way of the drawings. There are shown:

FIG. 1 schematically shows a lateral view of a device 1 according to the invention. The device consists of one or more components connected after one another. In a first coating arrangement 12 a paste-like plastic layer is deposited in sections or points 8 (FIG. 2) on a mostly moist sheet formation 2 delivered by preceding treatment steps. With a scattering arrangement 13 arranged after a coating arrangement 12, subsequently a layer of powder-like thermoplastic plastic is scattered flatly onto the sheet formation 2.

Figure 1:
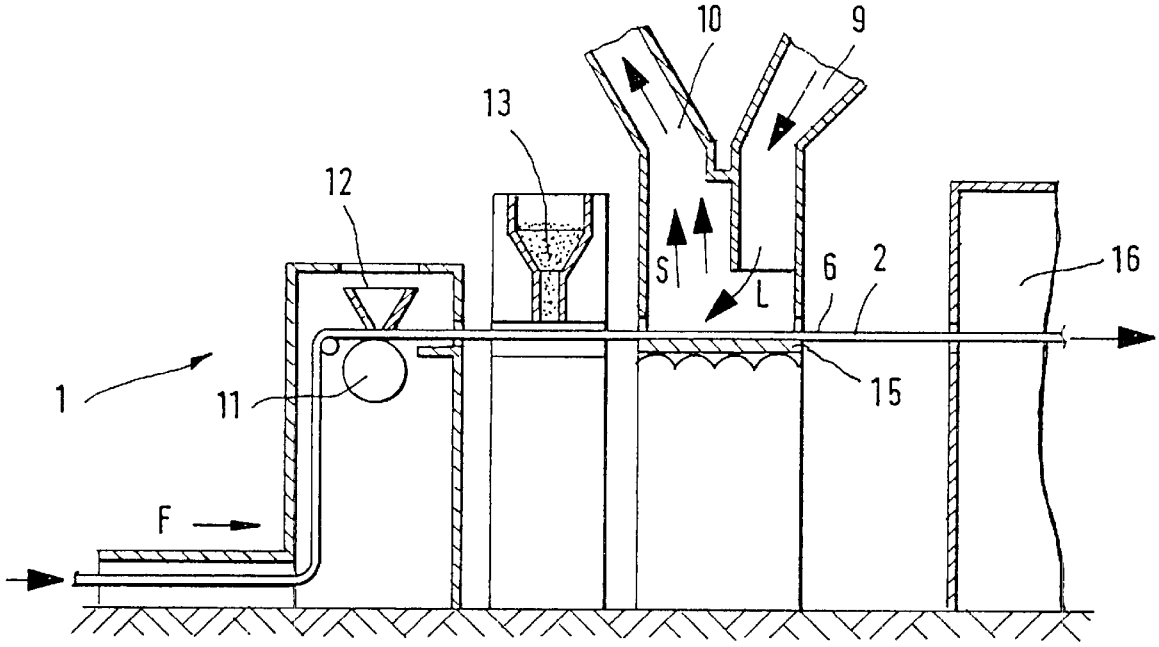
FIG. 1 a schematic representation of a device according to the invention.

At the end of the treatment procedure the sheet formation 2 is led to a treatment arrangement 16 which is shown only schematically. The sheet formation 2 is dried in the treatment arrangement 16 and is heated to the melting temperature of the coating material. Between the scattering arrangement 14 and the treatment arrangement 16 there is arranged a blow means 9 and a suction means 10. The suction means is arranged directly over the material web.

By way of the blow means 9 an air jet L can be directed against the surface 6 of the sheet formation 2. In this way the powder deposited between the sections of the first layer is swirled up. The suction means 10 sucks off the swirled up powder in a suction jet S. In FIG. 1 there is further shown an impact plate 15 via which the the sheet formation 2 is guided.

Figure 2:
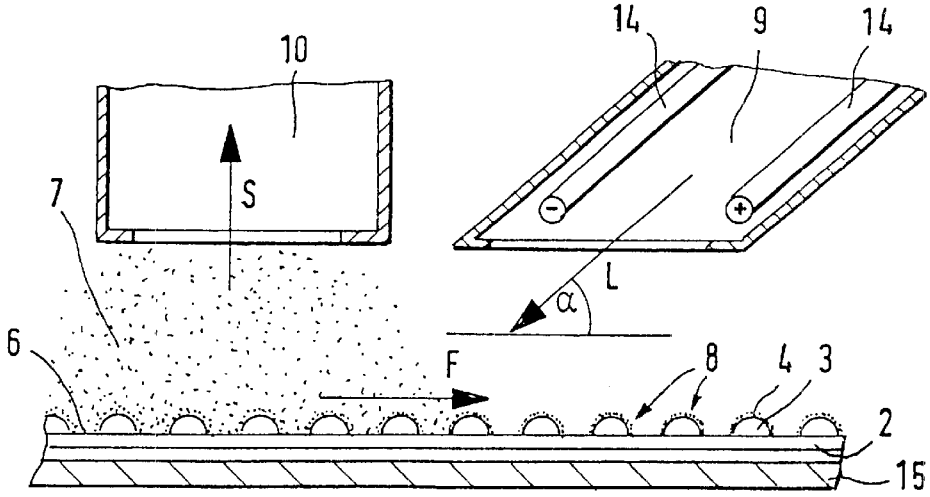
FIG. 2 an enlarged representation of the blow means and the suction means.

FIG. 2 shows a detailed illustration of the blow means 9, the suction means 10 and the sheet formation 2. The coating of the sheet formation 2 is effected at individual points 8. Each point 8 consists of a first layer 3 of a paste-like plastic and of a second layer 4 scattered on as powder. The sheet formation 2 scattered uniformly with powder is guided past the blow means 9 and the suction means 10. The blow means 9 blows an air jet L at an angle $\alpha$ against the surface of the sheet formation 2. The air jet L is directed against the conveying direction F of the sheet formation 2. Two electrodes 14 are connected to a high-voltage source which is not shown and which supplies them with an alternating voltage. By way of the alternating field, static charging of the powder 7 is broken down which simplifies the swirling. The powder 7 swirled up by the air jet L is sucked off in a suction jet S by the suction means 10. After passing the blow means 9 and the suction means 10, the powder 7 only remains sticking to the adhesive surface of the paste-like points 8. The sections between the individual points 8 are free of powder. The sheet formation 2 is, as is shown in FIG. 2, also led over an impact plate 15 which on the one hand permits a precise guiding of the sheet formation 2 and which on the other hand with permeable sheet formations defines the accumulation and swirling region for the air jet L.

Figure 3:
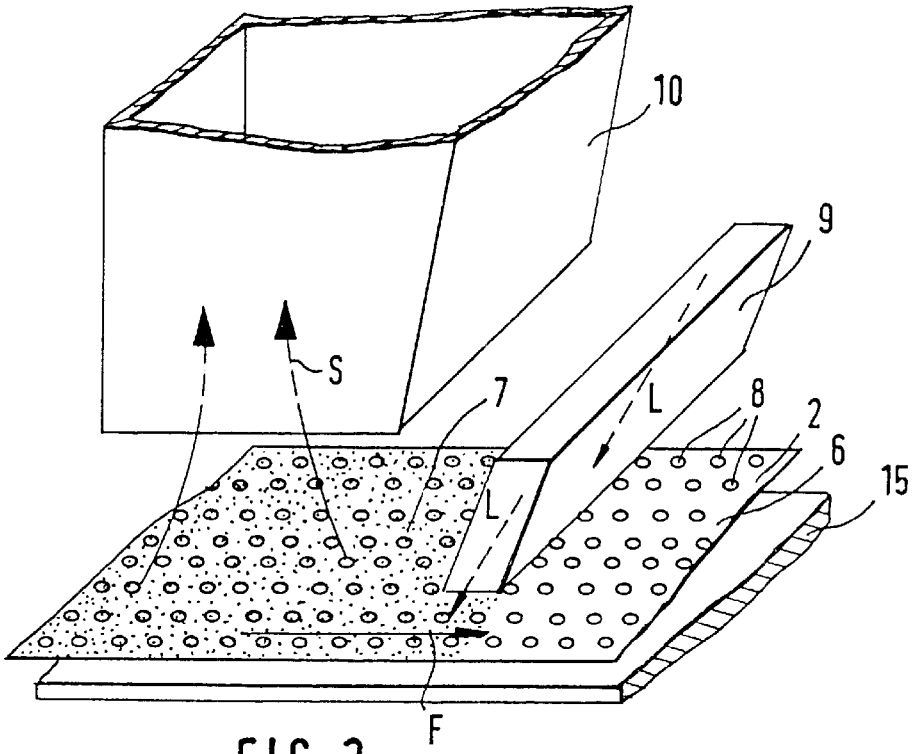
FIG. 3 a schematic representation of a blow means and a suction means.

FIG. 3 schematically shows a three-dimensional representation of the sheet formation 2 in the region of the blow means 9 and the suction means 10. The airflow L of the blow means 9 swirls up the powder 7 from the surface 6 of the sheet formation 2. The powder dust 7 which is swirled up is sucked off in a suction jet S by the suction means. FIG. 3 likewise shows the impact plate 15 via which the sheet formation 2 is guided. The powder which is flatly scattered on for forming the second layer 4 shown in FIG. 2 remains stuck only in sections where previously a first layer of a paste-like plastic was deposited. In this manner a powder coating at individual points 8 is possible.

Figure 4A:
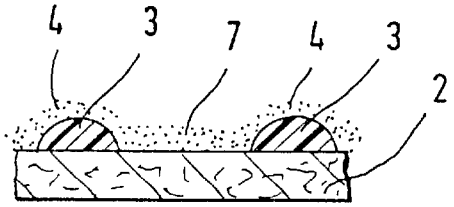
FIGS. 4*a* and 4*b* a schematic representation of coating points before and after sucking off the powder.

FIG. 4*a* shows a detail of the sheet formation 2 shortly after scattering on the powder 7. On the sheet formation 2 individual points of a first layer 3 of a paste-like plastic are deposited. Over the first layer 3 a second layer 4 of a powder 7 is flatly scattered.

Figure 4B:
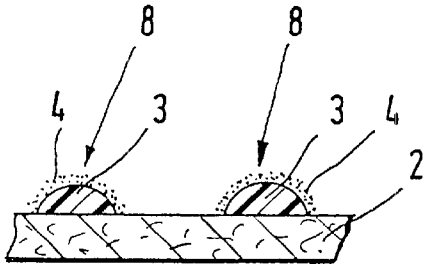

FIG. 4*b* shows the same detail of the sheet formation 2 after passing the blow means 9 and the suction means 10 shown in the previous figure. The powder 7 is sucked off in the sections between the individual sections of the first layer 3. There remains left over individual points 8 which consist of a first layer 3 and a second layer 4. The sheet formation 2 coated in this way may, in a treatment arrangement connected thereafter, undergo a thermal treatment (see FIG. 1) in which the layer 4 which is still powder-like can be melted.

What is claimed is:

1. A device for coating a surface of a continuously delivered material web with a first paste-like plastic layer deposited on said surface in sections and a second layer of thermoplastic plastic powder flatly scattered over said surface, wherein the device comprises a coating arrangement for depositing the first layer on said surface of the web, a scattering arrangement for scattering said powder onto said surface of the web, means for conveying the web from said coating arrangement to said scattering arrangement, a treatment arrangement for thermally treating the coating web arranged after said scattering arrangement and at least one air jet above the surface of the web and directed against the surface of the web at an angle of 80° to 30° for swirling up the powder between said scattering arrangement and said treatment arrangement, suction means for removing the powder which is swirled up, and an ionisation arrangement disposed in the path of said air jet for ionising the air jet and for producing an electrical alternating field.

* * * * *